United States Patent [19]

Mumford

[11] 4,059,198

[45] Nov. 22, 1977

[54] VAPOR-SEAL SAFETY CAP AND CONTAINER

[75] Inventor: George V. Mumford, Toledo, Ohio

[73] Assignee: Owens-Illinois, Inc., Toledo, Ohio

[21] Appl. No.: 762,611

[22] Filed: Jan. 26, 1977

[51] Int. Cl.[2] ..... B65D 55/02; B65D 85/56

[52] U.S. Cl. ..... 215/222; 215/211; 215/212; 215/350

[58] Field of Search ..... 215/211, 212, 222, 358, 215/341, 344, 350

[56] References Cited

U.S. PATENT DOCUMENTS

| | | | |
|---|---|---|---|
| 3,608,764 | 9/1971 | Hedgewick | 215/222 |
| 3,931,891 | 1/1976 | Peppler | 215/222 |

*Primary Examiner*—George T. Hall

*Attorney, Agent, or Firm*—A. J. Steger; E. J. Holler

[57] ABSTRACT

An improved vapor-seal, child-resistant closure and container combination is disclosed herein. The container comprises a cylindrical plastic body which is molded in one piece and has circumferentially spaced, radially extending projections on the upper end thereof that have notches therein. The closure comprises a one-piece plastic body having a top panel and an annular depending skirt with circumferentially spaced lugs extending radially inwardly for engagement with the notches. An annular integral rim or abutment is provided on the annular surface of the top panel of the closure and depends downwardly therefrom. A unique, one-piece, vapor-seal liner is interposed between the annular abutment and the lugs for engagement with the upper end of the container. The one-piece liner comprises a disc member which engages the annular rim of the container and includes a downwardly depending plug member which provides a vapor-tight seal with the inside surface of the container. The liner also serves as a spring between the closure and the container to bias the closure lugs into engagement with the projections on the container.

1 Claim, 5 Drawing Figures

VAPOR-SEAL SAFETY CAP AND CONTAINER

BACKGROUND OF THE INVENTION

This invention relates to child-resistant closures and containers. More specifically, this invention relates to a child-resistant closure and container combination which incorporates an improved vapor-sealing liner system.

A serious problem that has long existed with respect to the handling of drugs is that drugs are often packaged in containers that can be readily opened by children, resulting in many serious injuries or deaths. A variety of child-resistant safety closures have been introduced, such as the safety cap and container discussed in the U.S. Pat. to Hedgewick, No. 3,344,942, issued Oct. 3, 1967. The problem with this safety closure and many others is that its construction provides no means for preventing moisture vapor from penetrating through to the contents of the container. It has been found that exposure to moisture vapor can be very destructive to various types of medicines.

Various attempts have been made to incorporate a vapor seal into a safety closure, such as, for example, those concepts taught by the U.S. Pat. Nos. to Hedgewick et al, 3,478,911 issued Nov. 18, 1969, and Hedgewick et al, 3,485,403 issued Dec. 23, 1969. However, it has been found that the sealing liners suggested by the aforementioned Hedgewick patents have not been sufficiently resilient to withstand repeated opening and reapplication of the closure to the container. Thus, the vapor-sealing effectiveness of such constructions has dimished with continued use of these devices over a period of time.

SUMMARY OF THE INVENTION

It is, therefore, an object of this invention to provide an improved vapor-sealing, child-resistant closure and container combination.

Generally, the container comprises a cylindrical plastic body which has circumferentially spaced, radially extending projections on the upper end thereof, that have notches therein. The child-resistant closure of this invention comprises a one-piece plastic body having a top panel and a depending annular skirt with circumferentially spaced lugs extending radially inwardly for engagement with the notches. An annual integral ring or abutment is provided on the inside surface of the top panel. A unique, one-piece liner is interposed between the annular abutment and the lugs for engagement with the upper rim of the container and the inside surface of the container. The liner is formed from a flexible, resilient material which forms a spring member between the closure and container. The one-piece liner comprises a disc member which engages the upper rim of the container and includes a downwardly depending plug member which provides a vapor-tight seal with the inside surface of the container. The liner also serves as a spring between the closure and the container to bias the closure lugs into engagement with the projections on the container.

Other objects, features and advantages of this invention will become apparent to one skilled in the art upon reference to the following detailed description of the invention and the drawings illustrating the invention.

IN THE DRAWINGS

DETAILED DESCRIPTIONS OF THE PREFERRED EMBODIMENTS

Figure 1:
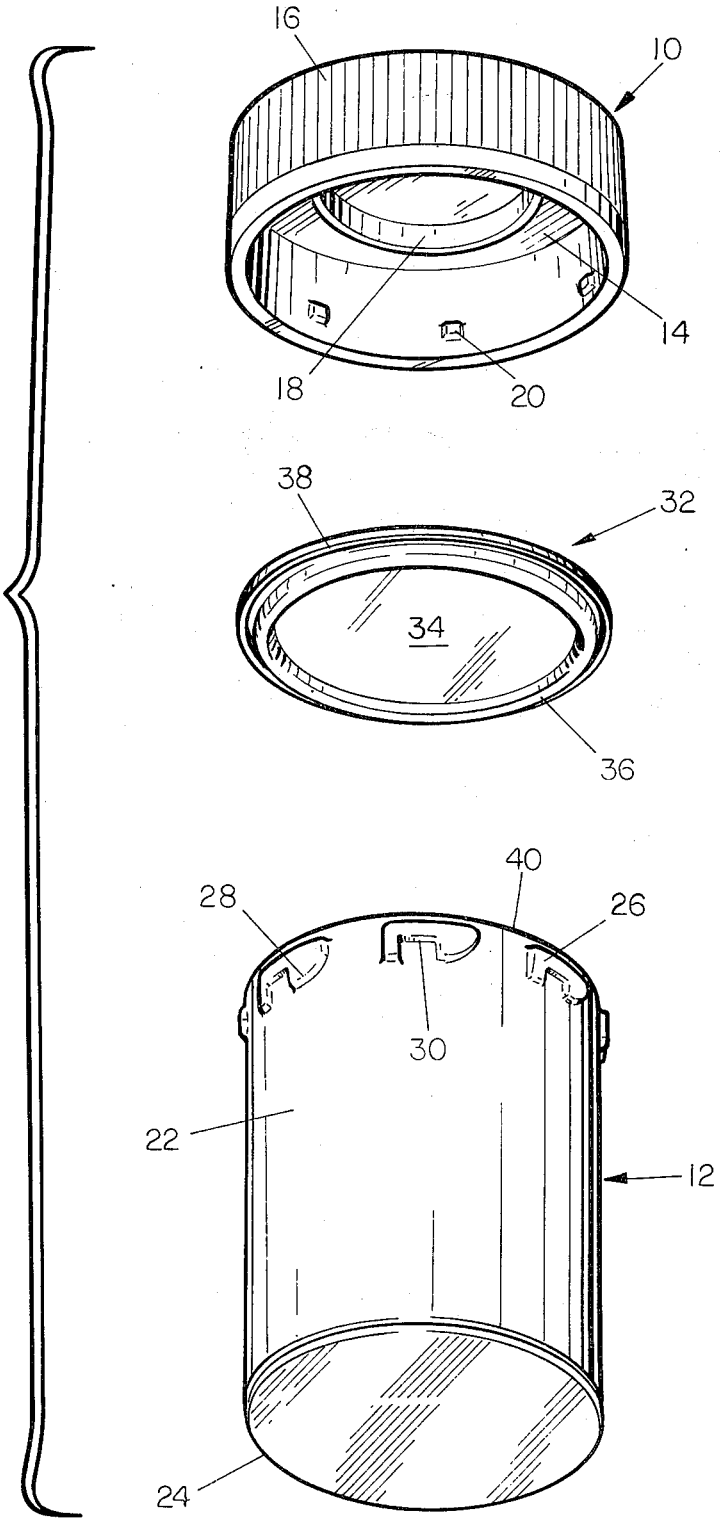
FIG. 1 is an exploded, perspective view of the component parts comprising the improved vapor-sealing, child-resistant closure and container combination of this invention.

Referring to FIG. 1, a child-resistant closure, indicated generally by the numeral 10, is illustrated as being adapted to be locked into engagement with a suitable container or vial, illustrated generally by the numeral 12. The closure 10 includes a top panel 14 and an annular skirt 16, which depends downwardly from the outer periphery of the top panel 14. The top panel 14 incorporates an annular rim or abutment 18, which is formed on the inner surface of the top panel 14 and depends downwardly therefrom. A plurality of inwardly extending lugs 20 are formed on the inner surface of, and spaced circumferentially around, the annular depending skirt 16.

The container 12 includes a cylindrical sidewall 22, which is open at the top and closed at the bottom by means of a circular bottom panel 24. A plurality of circumferentially spaced, radially extending projections 26 are formed on the upper end of the outer surface of the cylindrical sidewall 22. The projections 26 incorporate tapered cam surfaces 28, which lead into the locking notches 30. The container 12 may also comprise a blown plastic container configuration.

When it is desired to press the closure 10 into locking engagement with the container 12, it is positioned on the container so that the lugs 20 pass between the projections 26. The closure is then rotated so that the locking lugs 20 slide along the camming surface 28 until they are received within the locking notches 30. The closure 10 may then be removed from locking engagement with the container 12 by pressing downwardly to move the closure 10 in an axial direction relative to the container 12 to thereby dislodge the locking lugs 20 from the locking notches 30. The closure can then be removed from the container by rotating it sufficiently to allow the locking lugs 20 to pass between the projections 26 and then lifting the closure from the container.

Figure 3:
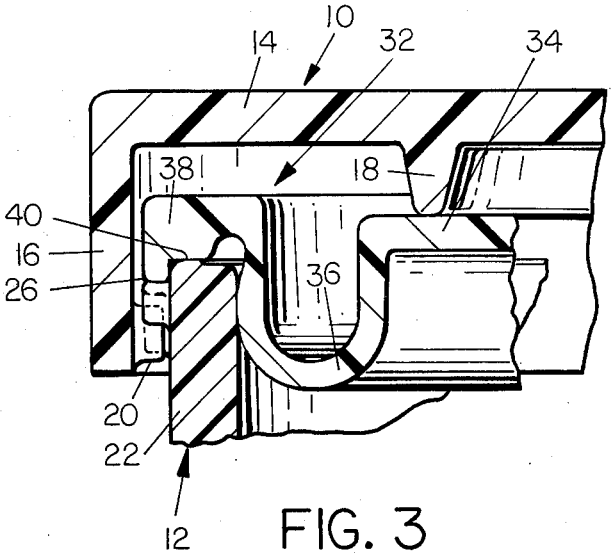
FIG. 3 is an enlarged, partial sectional view of the FIG. 2 embodiment showing the relationship of the members when the closure has been locked into engagement with the container.
Figure 2:
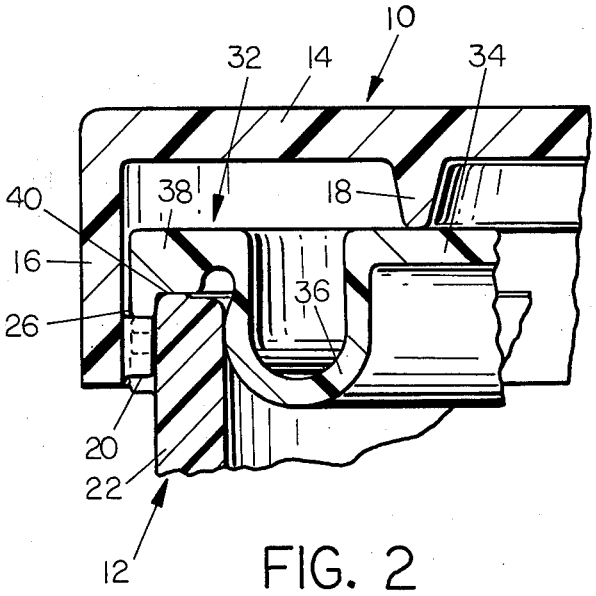
FIG. 2 is an enlarged, partial sectional view, showing the relationship between the closure and container and one embodiment of the one-piece liner of this invention positioned therebetween as the closure is applied to the container.
Figure 5:
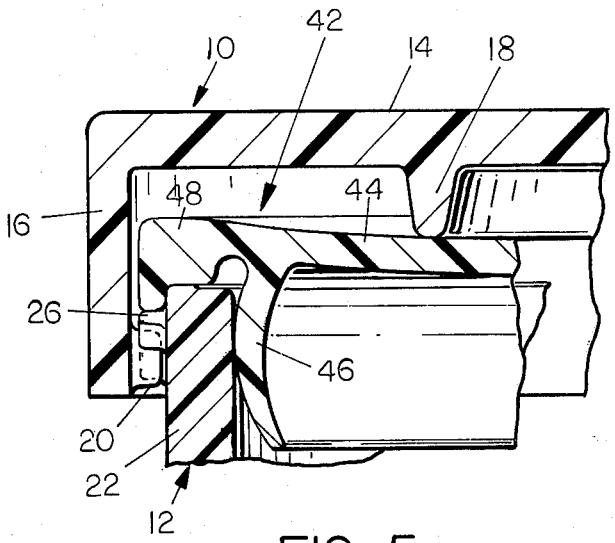
FIG. 5 is an enlarged, partial sectional view of the FIG. 4 embodiment showing the relationship of the members when the closure has been locked into engagement with the container.
Figure 4:
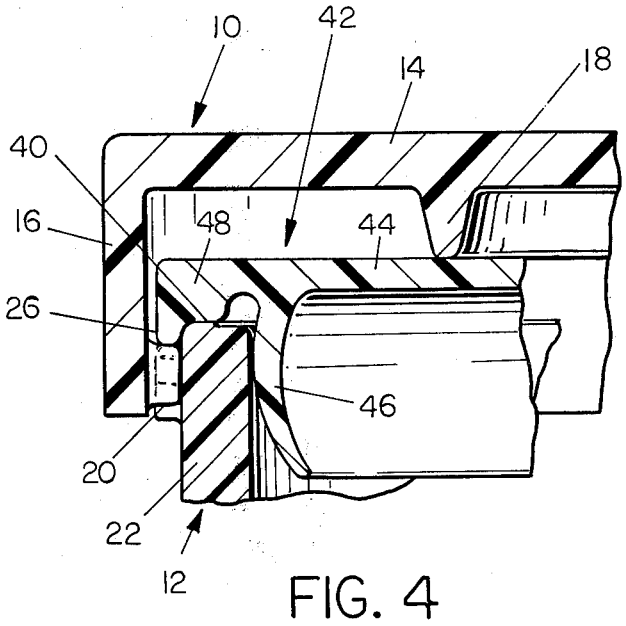
FIG. 4 is an enlarged, partial sectional view, showing the relationship between the closure and container and an alternate embodiment of the one-piece liner of this invention positioned therebetween as the closure is applied to the container.

A unique, one-piece liner is provided by this invention to serve as a spring member to hold the closure in locking engagement with the container and to provide a resilient vapor seal between the closure and the container. A first embodiment of the liner of this invention is illustrated in FIGS. 2 and 3, wherein a one-piece liner is indicated generally by the numeral 32. The liner 32 is disc-shaped and includes a central panel 34, a downwardly depending U-shaped annular plug portion 36 and an outer peripheral margin 38. The peripheral margin 38 engages an upper annular rim 40 on the container wall 22 and the plug portion 36 engages the interior surface of the container wall 22. A second embodiment of the liner of this invention is illustrated in FIGS. 4 and 5 wherein a one-piece liner is indicated generally by the numeral 42. The liner 42 also is disc-shaped and includes a central panel 44, a downwardly depending annular plug portion 46 in the shape of a curved flange and an outer peripheral flange 48. The peripheral margin 48 engages the upper annular rim 40 on the container wall 22, and the plug 46 engages the interior surface of the container wall 22. In each embodiment, it should be noted that the liner is carried by the closure as it fits between the locking lugs 20 and the annular abutment 18 on the closure.

The relationship of these members during the operation of the closure can best be seen by referring to FIGS. 2 and 3. In FIG. 2, the closure 10 has been positioned on the container 12 so that the locking lugs 20 pass between the locking projections 26 on the container. As this occurs, the annular abutment 18 on the closure contacts the central panel 34 of the liner 32. As the closure 10 is pushed downwardly and rotated so that the locking lugs 20 ride over the camming surfaces 28 and into engagement with the locking notches 30, the annular abutment 18 and the liner 32 assume the position shown in FIG. 3. In this position, the liner 32, which is formed of a flexible material, performs the function of a spring member to bias the closure upwardly relative to the container to thereby maintain the locking lugs 20 in locking engagement with the notches 30. In this same position, the U-shaped plug portion 36 is biased into sealing engagement with the interior surface of the container wall 22 to form a highly effective vapor seal to prevent the transmission of moisture vapor into the interior of the container. A second seal is provided by the engagement of the peripheral flange 38 and the annular rim 40 on the container 12. When it is desired to remove the closure from the container, a downward force must be applied to the closure against the spring action of the liner 32 so that the locking lugs 20 are moved downwardly a distance sufficient to allow them to be rotated out of the notches 30 and pass upwardly between the locking projections 26 as the closure is removed. The operation of the second embodiment illustrated in FIGS. 3 and 4 is identical to that of FIGS. 2 and 3.

Thus, it can be seen from the preceding description that a unique, one-piece liner is provided by this invention to be well suited to cooperate with a safety closure and container combination to provide both an effective spring force and a vapor seal between the closure and container. It is suggested that the one-piece liners could be formed from a non-permeable material, such as polyethylene.

WHAT I CLAIM IS:

1. A vapor-sealing, child-resistant closure and container combination comprising: an open-mouthed container having a plurality of circumferentially spaced projections extending radially outwardly adjacent the open end thereof, an annular rim portion on the open end thereof, said projections having a downwardly facing notch therein; a closure having a top panel and an annular skirt depending from the periphery of the top panel, a plurality of radially inwardly extending and circumferentially spaced lugs on the inner surface of said skirt, said lugs being adapted to engage the notches in the projections on the skirt of said container, an integral annular abutment formed on, and depending from, the inner surface of the top panel of said closure; and a one-piece liner formed from a flexible, resilient material and freely interposed between the free edge of the annular abutment and the lugs on the skirt of the closure, said liner including a central panel, a downwardly depending annular, W-shaped plug portion, and an outer peripheral margin, said annular abutment adapted to bias the central panel of the liner downwardly to force said plug portion into vaporsealing engagement with an interior surface of said container and the outer peripheral margin into sealing engagement with the annular rim on the container when the lugs on said closure are engaged within the notches in the projections on the skirt of the container.

* * * * *

UNITED STATES PATENT AND TRADEMARK OFFICE

CERTIFICATE OF CORRECTION

PATENT NO. : 4,059,198

DATED : November 22, 1977

INVENTOR(S) : George V. Mumford

It is certified that error appears in the above-identified patent and that said Letters Patent are hereby corrected as shown below:

Col. 4, line 36 (claim 1), "W-shaped" should be --U-shaped--.

Signed and Sealed this

*Twenty-fourth* Day of *June 1980*

[SEAL]

*Attest:*

SIDNEY A. DIAMOND

*Attesting Officer*

*Commissioner of Patents and Trademarks*